United States Patent [19]

Latham

[11] Patent Number: 4,712,305

[45] Date of Patent: Dec. 15, 1987

[54] FREEBOARD MEASURING DEVICE

[76] Inventor: Phillip A. Latham, P.O. Box 73600, Metairie, La. 70033

[21] Appl. No.: 850,025

[22] Filed: Apr. 10, 1986

[51] Int. Cl.[4] ..... G01B 3/02

[52] U.S. Cl. ..... 33/126.5; 73/300

[58] Field of Search ..... 33/126.5, 126.4 R, 126.7 R; 73/300

[56] References Cited

U.S. PATENT DOCUMENTS

| | | | |
|---|---|---|---|
| 327,726 | 10/1885 | Schoening | 33/126.7 R X |
| 1,478,288 | 12/1923 | MacGregor | 33/126.4 R X |
| 2,210,775 | 8/1940 | Perry | 33/126.5 X |
| 3,396,470 | 8/1968 | Wood | 33/126.5 |

*Primary Examiner*—William D. Martin, Jr.
*Attorney, Agent, or Firm*—Keaty & Keaty

[57] ABSTRACT

A device is disclosed for measuring the change in the freeboard of a barge, indicating a varying amount of cargo within the barge. An oil gauging tape is used to lower the device which comprises a vertical pipe transversed by a horizontal bar with an aperture therethrough. A flexible tube is coupled to a nipple which is secured to the underside of the block. Water, entering through the tube, flows into the vertical pipe and contacts and changes the color of a chalk or water-seeking paste material lightly spread on the graduated area of a gauging stick, resting in the vertical pipe. The device is lowered until the horizontal bar is submerged approximately 3" below the apparent surface of the water and the oil gauging tape is read for a measurement. The device is held steady to ensure that the vertical pipe is filled to the outside water level and is then reeled to the deck where the gauging stick is removed and the measurement of the water mark is noted and added to the measurement on the oil gauging tape. The sum of the two measurements provide the accurate freeboard reading.

19 Claims, 3 Drawing Figures

FREEBOARD MEASURING DEVICE

BACKGROUND OF THE INVENTION

1. Field of the Invention

The present invention relates to gauging devices, and more particularly to devices for measuring the change in the freeboard of a barge with a varying amount of cargo.

2. General Discussion of the Background

The pressing need to accurately measure the amount of cargo on barges and ships have compelled an exhaustive search by the American Shipping Industry to find the best cargo measurement method, thereby improving maritime infrastructure.

The prior art measurement devices of static scales and belt scales are highly inefficient and inaccurate. For example, static scales weigh cargo with at best, 0.2% error, without accounting for human error. Such scales are used as public weighing devices, for example, at truck weighing stations. Belt scales have also proven highly inaccurate in the measurement of bulk-like material, such as coal. For belt scale measurement, an accurate and truly representative sample must be obtained, which of course, poses much difficulty as shown by the 2–3% error in using this method.

Although the prior art does disclose an apparatus for measuring freeboard (U.S. Pat. No. 3,396,470—"-Wood"), such device allows freeboard measurements only where a slight surface chop on the water exists. Wood, as designed, will not work properly under conditions of deep swells extending two to three feet below the surface of the tube extending from the bottom of the prior art sounding devices which are not sufficient in length or flexibility to prevent a surge into the sounding tube as swells occur. In the typical prior art device such as Wood, the length and rigidity of Woods tube will prevent the device from working properly in a strong current as it will be swept downstream, preventing sufficient immersion for accurate readings.

To overcome the deficiencies in the prior art devices, the object of the applicant's invention is to provide a device and method for measuring the change in freeboard of a barge or the like, indicating a varying amount of cargo in both still and torrential waters where currents may otherwise sweep prior art devices, preventing accurate freeboard readings.

It is a further object of the applicant's invention to provide a device and method for accurate freeboard readings when barges or the like are tied close together without damaging the device and to allow night readings when glare from flash light would otherwise have obstructed the view of the water.

SUMMARY OF THE INVENTION

The applicant's invention, a device for measuring freeboard of a barge to determine change in cargo loads, is lowered by an oil gauging tape attached to a triangular bail, which in turn, is attached to the device itself.

The device generally comprises a metal, pipe-transversed by a horizontal square block, with an aperture through both the pipe and the block. A flexible tube is coupled to a nipple which is secured to the underside of the block. Lead weights are threaded onto the tubing, held onto the tubing by an open stopper engage to the tubing by a clamp.

To obtain an accurate freeboard reading, the device is lowered by the oil gauging tape to a point where the horizontal bar is at the apparent surface of the water. The device is further lowered at least 3" until an even inch reading is obtained and recorded. Upon submersion, water, entering through the flexible tube and flowing into the pipe changes the color of a chalk-like material or paste, spread lightly on the graduated area of a gauging stick resting within the pipe. The device is held steady for about 7 seconds to ensure that the vertical pipe is filled to the outside water level. Finally, the device is reeled to the deck, the gauging stick is removed and the reading is recorded. The sum of the reading on the oil gauging tape and the gauging stick is the true freeboard measurement.

The device, being only ¾" thick, permits the apparatus to be used between barges when they are fleeted side-by-side without causing damage to the unit. Furthermore, the stainless steel construction of the device prevents corrosion and adds weight so that additional weights need not be added for normal use. However, in the event of torrential winds or current, lead weights are threaded over the flexible, plastic tube to achieve greater stability.

The device also permits night surveying with accuracy when vision may be impaired by glaring of flashlights, preventing proper measurement when using prior art devices.

Finally, the device is simple to understand and use and enables laymen to read and record accurate freeboard readings.

In another embodiment of the present invention, a vertical metal tube 2' to 3' in length may be used in lieu of the flexible, plastic tube for highly turbulent areas where the plastic tube may not remain properly submerged.

In a further embodiment, the present invention may be attached to and lowered by a calibrated, oil tank gauging stick in lieu of using the oil gauging tape where there are unusually strong currents.

DETAILED DESCRIPTION OF THE PREFERRED EMBODIMENTS

Figure 1:
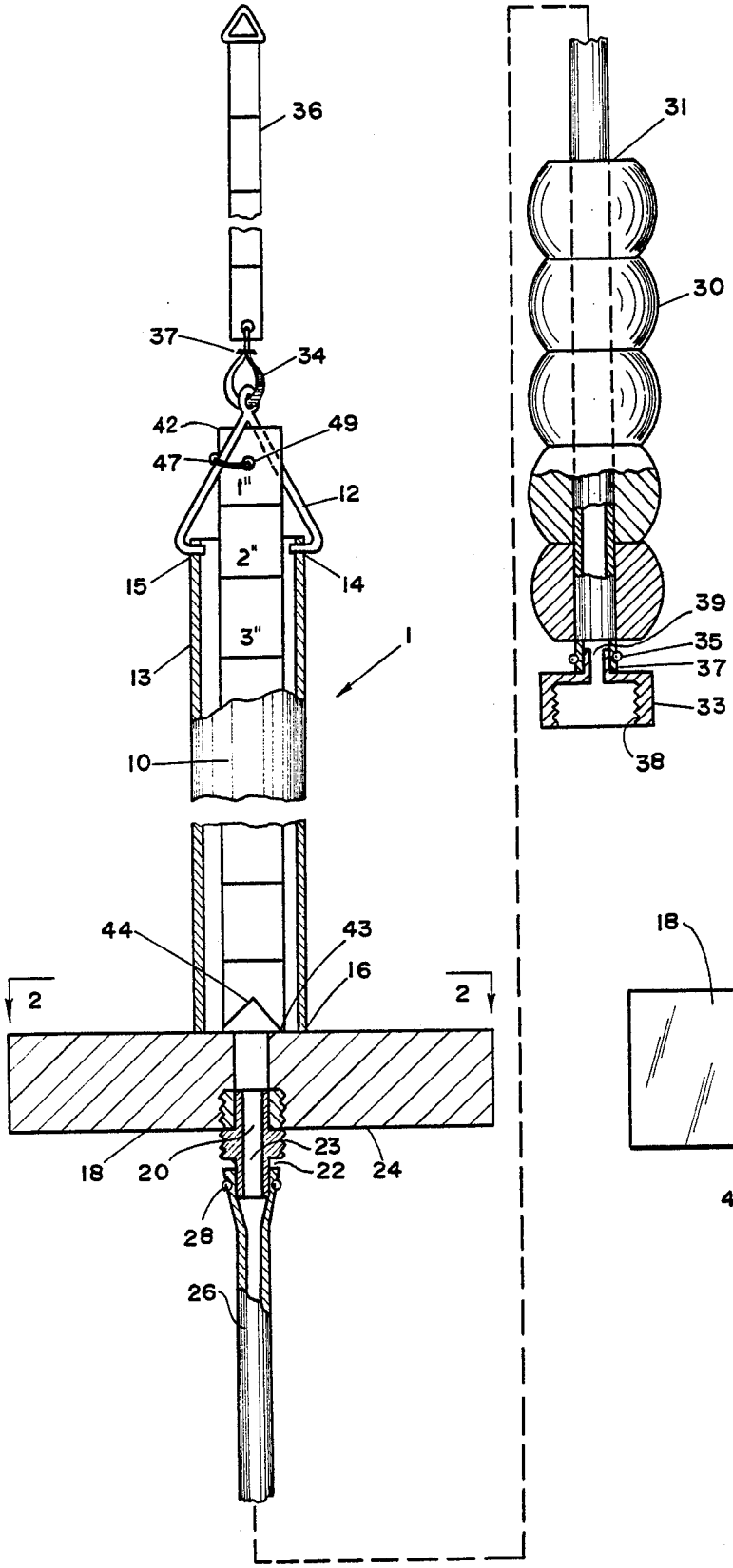
FIG. 1 is an exploded view of the freeboard measuring device, including cutaway sections to better view the device's internal structure.
Figure 2:
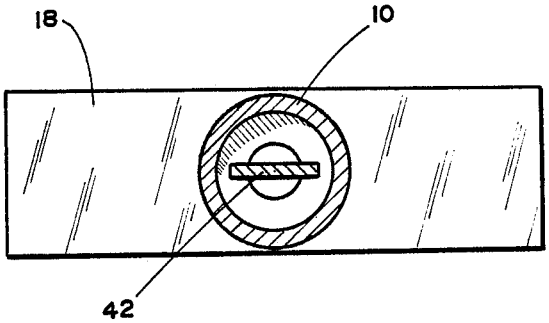
FIG. 2 is a plan view of the horizontal bar of the applicant's invention.

Referring now to the drawings, wherein the like numerals indicate identical or corresponding parts throughout the several views, and more particularly to FIG. 1 thereof, a perspective view of an embodiment of the present invention is depicted. A freeboard measuring device 1 generally comprises a ¾" O.D. stainlss steel pipe 10, about 24" in length, to which a stainless steel wire bail 12 is attached at the top 13 through two holes 14 and 15, drilled in pipe 10.

The pipe bottom 16 is welded to a ¾" by ¾" by 6" stainless steel, transverse square bar 18 having a length substantially greater than the outside diameter of pipe 10, centered over a pre-drilled and threaded hole 20, approximately ¼" in diameter. A stainless steel nipple piece of reduced diameter 22 is screwed into hole 20 at the bottom 24 of the square bar 18. A ¼" flexible plastic tube 26 is coupled "over" the nipple 22 by a stainless steel hose clamp 28. The plastic tube 26 can be any desired length from 1'-06" to 10' or longer. Spherical lead balls 30, ¾" in diameter with apertures 31 therethrough, are slipped over the plastic tube 26 to serve as weights. Weight can be increased or decreased for proper tube submersion in the water according to the strength of the wind and current. The lower end 37 of the plastic tube 26 is connected to a ½" diameter end piece 33 coupled to tube 26 with a stainless steel hose clamp 35. The end piece 33, approximately 2" in length, is drilled to form a first, outside chamber 38 and a second, internal chamber 39 having a restricted diameter, smaller than the diameter of chamber 38. Stainless steel or copper scouring pad material (not shown) or similiar non-corrosive material is packed inside chamber 38 to prevent surging of water in the tube 26 while permitting a free flow of outside water to seek its own level in the ¾" pipe 10. These chambers (38 and 39), along with the restricted diameter passage 23 of nipple 22, serve as means for preventing surging of water inside tube 26. The end piece 33 is threaded to receive a ¾" O.D. cap (not shown) with a 3/16" opening to retain the anti-surge material (not shown). As shown in FIG. 1, cross width of the end piece, or stopper means, 33 is substantially greater than the outside diameter of the flexible tube 26. The internal diameter of apertures 31 is slightly greater than the outside diameter 18 of the tube 26. In this manner, the stopper 33 prevents an undesirable accidental removal of the lead balls 30 from their sliding engagement with the tube 26.

The provision of the removable nipple 22 and the detachable end piece 33 allows easy cleaning of the restricted passageways 23 and 39 in case if they become clogged. Additionally, the flexible tube 26 can be cleaned easily and expeditiously, thus preventing costly delays in freeboard measuring operations. The bail 12 of the device 1 is attached to 25' or longer oil gauging tape 36 using hook and swivel joints 32 with a handle reel hook 34 and steel tape (not shown) with a ⅛" inch graduated scale. A gauging stick 42, ½" wide by ½" thick, stainless steel is approximately 2 inches longer than the length of the ¾" steel pipe 10, fitting inside the pipe 10. A point that precisely corresponds to "O" point for the oil gauging tape 36 is scribed on the width of the gauging stick 42. Although both the oil gauging tape 36 and gauging stick 42 are marked in English units (feet and inches), metric units may be used as well.

As can be seen in FIG. 1, the gauging stick terminates below the apex of bail 12, not reaching the swivel connection, so that a change of angle between the flexible oil gauging tape and the rigid pipe 10 does not cause the gauging stick 42 to contact the bail or the swivel connection which may lead to the gauging stick 42 being bent or otherwise damaged.

The scribed "O" point on the gauging stick 42 corresponds to the bottom of the oil gauging tape 36. A notch 44 is ground into the bottom 43 of the gauging stick 42 to prevent the stick 42 from interfering with the flow of water into the pipe 10. The gauging stick is retained in pipe 10 by a wire 47 threaded through an aperture 49 on the gauging stick 42, where the wire 47 may also be attached to the bail 12. Water entering through tube 26 and into pipe 10 contacts and changes the color of chalk material or water seeking paste (not shown) which has been spread lightly on the graduated area of the gauging stick 42. The stick 42 extends from "O" point on the oil gauging tape to approximately 2½" above the bottom of the ¾" stainless steel pipe 10.

Figure 3:
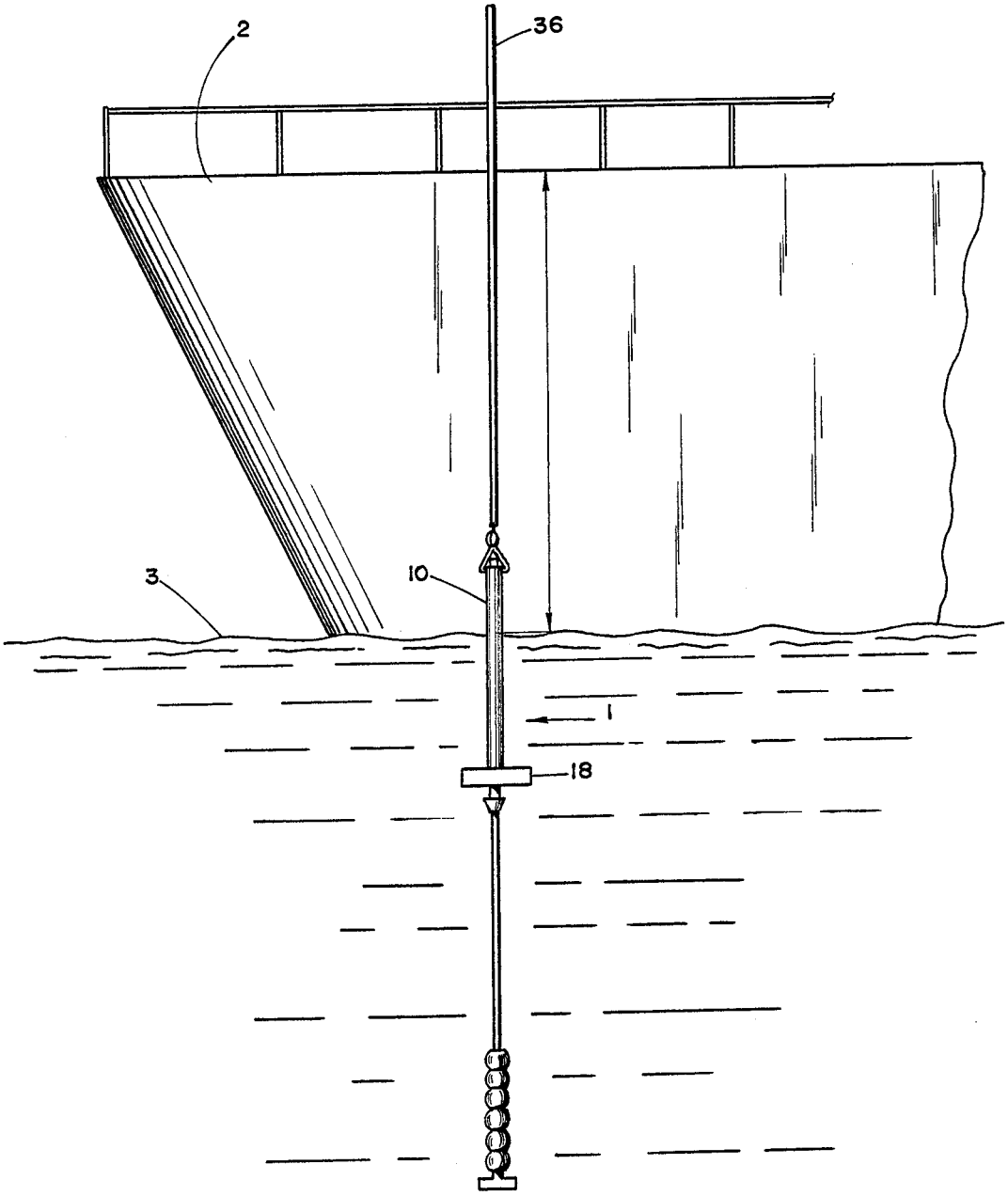
FIG. 3 is a perspective view of the freeboard measuring device in use.

The device 1 is used by adhering to the following steps:

(a) The device 1 is used by placing a suitable straight edge of wood or metal (not shown) at the desired location on the main deck of a barge 2 (FIG. 3), to serve as a planar indicator of the deck for a proper freeboard reading.

(b) The oil gauging tape 36 is used to lower the device 1 to a point where the horizontal square bar 18 is at the apparent surface of the water 3.

(c) The device 1 is then further lowered a minimum of 3" until an even inch reading at the straight edge is obtained and recorded.

(d) The device 1 is held steady for about 7 seconds to ensure that the vertical pipe 10 is filled to the outside water level and is then reeled to the deck of the barge 2.

(e) The gauging stick 42 is removed and the measurement at the water mark is noted and added to the freeboard reading taken at the straight edge on the main deck of the barge 2. The sum of the two measurements provide the accurate freeboard reading.

The water discolored area of chalk may be cleaned and procedures a–e above repeated at the next desired location for average freeboard readings. The device 1 is lowered until the square bar 18 is again at the water surface 3, but with the device 1 lowered an additional inch to the nearest inch mark at the straight edge. The procedure can be repreated until all the necessary freeboard readings are taken by lowering the apparatus an additional inch for each reading.

By lowering the apparatus 1" deeper for each subsequent freeboard reading, the water seeking paste or chalk need not be reapplied for six (6) to eight (8) readings, allowing all the required readings to be taken at a much faster pace.

Modification and variation may be made to the disclosed embodiment without departing from the subject matter of the invention as defined in the following claims. The disclosure of the preferred embodiment has been made in accordance with requirements of patent law, and is not intended to limit the scope of the invention as defined in the following claims.

I claim:

1. A device for measuring the freeboard of a barge or structure on a body of water, comprising:

a vertical pipe;

a horizontal bar with an aperture therethrough, said bar connected to said pipe in substantially perpendicular relationship;

a means for water ingress securedly, removably attached to said horizontal bar opposite said vertical pipe;

a means for reading freeboard measurement mounted, at least in part, within said vertical pipe;

a means for lowering said device into said water attached to said vertical pipe opposite said horizontal bar;

a means for stabilizing said device in said water, mounted on the means for water ingress; and a means for preventing surging of water inside the apparatus associated with said means for water ingress.

2. The device of claim 1 wherein said means for water ingress comprises a tube with an upper and a lower end, connected to said horizontal bar at the tube's upper end, said aperture in the bar allowing ingress of water through the tube into said pipe.

3. The device of claim 2, wherein said means for reading freeboard measurement, further comprises:
a measuring tape; and
a gauging stick within said pipe.

4. The device of claim 3 wherein said means for lowering said device is said measuring tape.

5. The device of claim 4 wherein said means for stabilizing comprises weights mounted on said tube.

6. The device of claim 5 wherein said weights are made of lead.

7. The device of claim 6 wherein said means for stabilizing further comprises:
an end piece with an aperture therethrough, coupled to said lower end of said tube; and
a clamp further securing said end piece to the lower end of said tube.

8. The device of claim 4, wherein said means for lowering further comprises:
a bail, securing said pipe to said measuring tape.

9. The device of claim 3, wherein applied to said gauging stick is a water alterable material which provides indication of water level on contact of water to said material.

10. The device of claim 1, wherein matingly threaded into said aperture is an extruding nipple.

11. The device of claim 10, wherein said tube is coupled over said nipple.

12. The device for measuring the freeboard of a barge of structure on a body of water, comprising:
a vertical pipe;
a horizontal bar with an aperture therethrough, said bar connected to said pipe in substantially perpendicular relationship;
a means for allowing water ingress into said vertical pipe, comprising:
a tube with an upper and a lower end, connected to said horizontal bar at the tube's upper end, said aperture in said bar allowing ingress of water through the tube into said pipe;
an extruding nipple, threaded into said aperture of said bar, connecting said bar and said tube;
a means for reading freeboard measurement, comprising:
a measuring tape attached to the vertical pipe opposite said bar; and
a gauging stick, positioned inside the vertical pipe, wherein applied to said stick is a water alterable material which provides indication of water level on contact of water to said material;
a means for lowering said device into said water, comprising:
a bail, securing said pipe to said measuring tape;
means for stabilizing said device in said water, comprising:
lead weights threaded over said tube;
an end piece, with an aperture therethrough, coupled to the lower end of said tube; and
a clamp further securing said end piece to the lower end of said tube.

13. The device of claim 1 wherein said means for water ingress comprises a rigid tube.

14. An apparatus for measuring freeboard of a vessel, comprising:
a rigid pipe having an axial opening therethrough;
a transverse bar fixedly attached to one end of said pipe, said bar having a central aperture therethrough coaxially aligned with the opening in the pipe;
a flexible tube removably, securedly connected to the bar opposite said rigid pipe in coalighnment with the bar aperture and adapted for allowing inlet of water into the rigid pipe;
means for indicating the freeboard measurement mounted, at least in part, inside the rigid pipe; and
means for preventing surging of water inside the apparatus, said means comprising a stopper means coupled to the flexible tube at an end thereof, the end piece comprising a first chamber packed with a non-corrosive porous material allowing free flow of water into the tube and a second chamber of a restricted diameter in fluid communication with the first chamber, and a reduced diameter nipple means positioned intermediate said flexible tube and said transverse bar in fluid communication with the bar 15. The apparatus of claim 14, wherein the means for indicating the freeboard measurement comprise a gauging tape connected to the end of the rigid pipe through a swivel member opposite said transverse bar and a gauging stick mounted within said rigid pipe.

16. The apparatus of claim 15, wherein the gauging stick terminates a distance below the swivel member to prevent contact of the gauging stick and the swivel member.

17. The apparatus of claim 14, wherein the transverse bar has a length substantially greater than an outside diameter of the rigid pipe to facilitate observation of the device being lowered into the water.

18. The apparatus of claim 14, wherein an outside diameter of the stopper means is substantially greater than an outside diameter of the flexible tube.

19. The apparatus of claim 18, further comprising at least one weight member slidably mounted on the flexible tube and wherein the stopper means prevents an accidental removal of the weight member from the flexible tube.

* * * * *